US009183850B2

(12) United States Patent
Bradley et al.

(10) Patent No.: US 9,183,850 B2
(45) Date of Patent: Nov. 10, 2015

(54) SYSTEM AND METHOD FOR TRACKING SOUND PITCH ACROSS AN AUDIO SIGNAL

(75) Inventors: David C. Bradley, La Jolla, CA (US); Daniel S. Goldin, Malibu, CA (US); Rodney Gateau, San Diego, CA (US); Nicholas K. Fisher, San Diego, CA (US); Robert N. Hilton, San Diego, CA (US); Derrick R. Roos, San Diego, CA (US); Eric Wiewiora, San Diego, CA (US)

(73) Assignee: The Intellisis Corporation, San Diego, CA (US)

( * ) Notice: Subject to any disclaimer, the term of this patent is extended or adjusted under 35 U.S.C. 154(b) by 739 days.

(21) Appl. No.: 13/205,483

(22) Filed: Aug. 8, 2011

(65) Prior Publication Data

US 2013/0041656 A1 Feb. 14, 2013

(51) Int. Cl.

| | |
|---|---|
| ***G10L 21/00*** | (2013.01) |
| ***G10L 25/90*** | (2013.01) |
| *G10L 25/93* | (2013.01) |
| *G10L 25/03* | (2013.01) |

(52) U.S. Cl.

CPC ..... *G10L 25/90* (2013.01); *G10L 25/03* (2013.01); *G10L 25/93* (2013.01); *G10L 2025/906* (2013.01)

(58) Field of Classification Search

CPC ..... G10L 25/90
USPC ..... 704/207
See application file for complete search history.

(56) References Cited

U.S. PATENT DOCUMENTS

| | | | | |
|---|---|---|---|---|
| 3,617,636 | A | 11/1971 | Ogihara | 179/1 SA |
| 3,649,765 | A | 3/1972 | Rabiner et al. | 179/15 A |
| 4,454,609 | A | 6/1984 | Kates | 381/68 |
| 4,797,923 | A | 1/1989 | Clarke | 381/31 |

(Continued)

FOREIGN PATENT DOCUMENTS

| | | | |
|---|---|---|---|
| CN | 101027543 | A | 8/2007 |
| CN | 101394906 | A | 3/2009 |

(Continued)

OTHER PUBLICATIONS

Yin et al., "Pitch- and Formant-Based Order Adaptation of the Fractional Fourier Transform and Its Application to Speech Recognition", *EURASIP Journal of Audio, Speech, and Music Processing*, vol. 2009, Article ID 304579, [online], Dec. 2009, Retrieved on Sep. 26, 2012 from http://downloads.hindawi.com/journals/asmp/2009/304579.pdf, 14 pages.

(Continued)

*Primary Examiner* — Shaun Roberts
(74) *Attorney, Agent, or Firm* — Edell, Shapiro & Finnan, LLC

(57) ABSTRACT

A system and method may be configured to analyze audio information derived from an audio signal. The system and method may track sound pitch across the audio signal. The tracking of pitch across the audio signal may take into account change in pitch by determining at individual time sample windows in the signal duration an estimated pitch and an estimated fractional chirp rate of the harmonics at the estimated pitch. The estimated pitch and the estimated fractional chirp rate may then be implemented to determine an estimated pitch for another time sample window in the signal duration with an enhanced accuracy and/or precision.

23 Claims, 5 Drawing Sheets

(56) References Cited

U.S. PATENT DOCUMENTS

| | | | | |
|---|---|---|---|---|
| 5,054,072 | A | 10/1991 | McAulay et al. | 381/31 |
| 5,195,166 | A | 3/1993 | Hardwick et al. | 395/2 |
| 5,216,747 | A | 6/1993 | Hardwick et al. | 395/2 |
| 5,226,108 | A | 7/1993 | Hardwick et al. | 395/2 |
| 5,321,636 | A | 6/1994 | Beerends | 364/485 |
| 5,548,680 | A | 8/1996 | Cellario | 395/2.28 |
| 5,684,920 | A | 11/1997 | Iwakami et al. | 395/2.12 |
| 5,812,967 | A * | 9/1998 | Ponceleon et al. | 704/207 |
| 5,815,580 | A | 9/1998 | Craven et al. | |
| 6,356,868 | B1 | 3/2002 | Yuschik et al. | 704/246 |
| 6,477,472 | B2 | 11/2002 | Qian et al. | 702/35 |
| 6,526,376 | B1 | 2/2003 | Villette et al. | 704/207 |
| 7,003,120 | B1 | 2/2006 | Smith et al. | |
| 7,016,352 | B1 | 3/2006 | Chow et al. | |
| 7,117,149 | B1 | 10/2006 | Zakarauskas | |
| 7,249,015 | B2 | 7/2007 | Jiang et al. | |
| 7,389,230 | B1 | 6/2008 | Nelken | |
| 7,596,489 | B2 | 9/2009 | Kovesi et al. | |
| 7,660,718 | B2 | 2/2010 | Padhi et al. | 704/268 |
| 7,664,640 | B2 | 2/2010 | Webber | |
| 7,668,711 | B2 | 2/2010 | Chong et al. | |
| 7,672,836 | B2 | 3/2010 | Lee et al. | 704/207 |
| 7,774,202 | B2 | 8/2010 | Spengler et al. | |
| 7,991,167 | B2 | 8/2011 | Oxford | |
| 8,189,576 | B2 | 5/2012 | Ferguson | |
| 8,212,136 | B2 | 7/2012 | Shirai et al. | |
| 8,332,059 | B2 | 12/2012 | Herre et al. | |
| 8,447,596 | B2 | 5/2013 | Avendano et al. | |
| 8,548,803 | B2 | 10/2013 | Bradley et al. | 704/208 |
| 8,620,646 | B2 | 12/2013 | Bradley et al. | 704/207 |
| 8,666,092 | B2 | 3/2014 | Zavarehei | |
| 8,767,978 | B2 | 7/2014 | Bradley et al. | |
| 2002/0152078 | A1 | 10/2002 | Yuschik et al. | 704/273 |
| 2003/0014245 | A1 | 1/2003 | Brandman | 704/205 |
| 2003/0055646 | A1 | 3/2003 | Yoshioka et al. | |
| 2004/0128130 | A1 | 7/2004 | Rose et al. | |
| 2004/0133424 | A1 | 7/2004 | Ealey et al. | 704/233 |
| 2004/0176949 | A1 | 9/2004 | Wenndt et al. | |
| 2004/0220475 | A1 | 11/2004 | Szabo et al. | |
| 2005/0114128 | A1 | 5/2005 | Hetherington et al. | |
| 2005/0149321 | A1 | 7/2005 | Kabi et al. | 704/207 |
| 2006/0080088 | A1 | 4/2006 | Lee et al. | 704/207 |
| 2006/0100866 | A1 | 5/2006 | Alewine et al. | |
| 2006/0122834 | A1 | 6/2006 | Bennett | |
| 2006/0149558 | A1 | 7/2006 | Kahn et al. | 704/278 |
| 2006/0262943 | A1 | 11/2006 | Oxford | |
| 2007/0010997 | A1 | 1/2007 | Kim | |
| 2007/0299658 | A1 | 12/2007 | Wang et al. | 704/207 |
| 2008/0082323 | A1 | 4/2008 | Bai et al. | |
| 2008/0183473 | A1 | 7/2008 | Nagano et al. | 704/258 |
| 2008/0270440 | A1 | 10/2008 | He et al. | 707/101 |
| 2009/0012638 | A1 | 1/2009 | Lou | |
| 2009/0076822 | A1 | 3/2009 | Sanjaume | |
| 2009/0091441 | A1 | 4/2009 | Schweitzer, III et al. | 340/531 |
| 2009/0228272 | A1 | 9/2009 | Herbig et al. | |
| 2010/0042407 | A1 | 2/2010 | Crockett | 704/200.1 |
| 2010/0215191 | A1 | 8/2010 | Yoshizawa et al. | |
| 2010/0260353 | A1 | 10/2010 | Ozawa | |
| 2010/0262420 | A1 | 10/2010 | Herre et al. | 704/201 |
| 2010/0332222 | A1 | 12/2010 | Bai et al. | |
| 2011/0016077 | A1 | 1/2011 | Vasilache et al. | |
| 2011/0060564 | A1 | 3/2011 | H ge | |
| 2011/0286618 | A1 | 11/2011 | Vandali et al. | |
| 2012/0243694 | A1 | 9/2012 | Bradley et al. | 381/56 |
| 2012/0243705 | A1 | 9/2012 | Bradley et al. | 381/94.4 |
| 2012/0243707 | A1 | 9/2012 | Bradley et al. | 381/98 |
| 2012/0265534 | A1 | 10/2012 | Coorman et al. | |
| 2013/0041489 | A1 | 2/2013 | Bradley et al. | 700/94 |
| 2013/0041656 | A1 | 2/2013 | Bradley et al. | |
| 2013/0041657 | A1 | 2/2013 | Bradley et al. | 704/207 |
| 2013/0041658 | A1 | 2/2013 | Bradley et al. | 704/208 |
| 2014/0037095 | A1 | 2/2014 | Bradley et al. | 381/56 |
| 2014/0086420 | A1 | 3/2014 | Bradley et al. | 381/56 |

FOREIGN PATENT DOCUMENTS

| | | | |
|---|---|---|---|
| EP | 1744 305 | A2 | 1/2007 |
| JP | 01-257233 | A | 10/1989 |
| WO | WO 2012/129255 | | 9/2012 |
| WO | WO 2012/134991 | | 10/2012 |
| WO | WO 2012/134993 | | 10/2012 |
| WO | WO 2013/022914 | | 2/2013 |
| WO | WO 2013/022918 | | 2/2013 |
| WO | WO 2013/022923 | | 2/2013 |
| WO | WO 2013/022930 | | 2/2013 |

OTHER PUBLICATIONS

Weruaga, Luis, et al., "Speech Analysis with the Fast Chirp Transform", *Eusipco*, www.eurasip.org/Proceedings/Eusipco/Eusipco2004/,../cr1374.pdf, 2004, 4 pages.

Kepesi, Marian, et al., "Adaptive Chirp-Based Time-Frequency Analysis of Speech Signals", *Speech Communication*, vol. 48, No. 5, 2006, pp. 474-492.

Ioana, Cornel, et al., "The Adaptive Time-Frequency Distribution Using the Fractional Fourier Transform", 18° *Colloque sur le traitement du signal et des images*, 2001, pp. 52-55.

Abatzoglou, Theagenis J., "Fast Maximum Likelihood Joint Estimation of Frequency and Frequency Rate", *IEEE Transactions on Aerospace and Electronic Systems*, vol. AES-22, Issue 6, Nov. 1986, pp. 708-715.

Rabiner, Lawrence R., "On the Use of Autocorrelation Analysis for Pitch Detection", *IEEE Transactions on Acoustics, Speech, and Signal Processing*, vol. ASSP-25, No. 1, Feb. 1977, pp. 24-33.

Lahat, Meir, et al., "A Spectral Autocorrelation Method for Measurement of the Fundamental Frequency of Noise-Corrupted Speech", *IEEE Transactions on Acoustics, Speech, and Signal Processing*, vol. ASSP-35, No. 6, Jun. 1987, pp. 741-750.

Xia, Xiang-Gen, "Discrete Chirp-Fourier Transform and Its Application to Chirp Rate Estimation", *IEEE Transactions on Signal Processing*, vol. 48, No. 11, Nov. 2000, pp. 3122-3133.

Boashash, Boualem, "Time-Frequency Signal Analysis and Processing: A Comprehensive Reference", [online], Dec. 2003, retrieved on Sep. 26, 2012 from http://qspace.qu.edu.qa/bitstream/handle/10576/10686/Boashash% 20book-part1 _tfsap_concepts.pdf?seq.., 103 pages.

Robel, A., et al., "Efficient Spectral Envelope Estimation and Its Application to Pitch Shifting and Envelope Preservation", *Proc. Of the 8th Int. Conference on Digital Audio Effects* (*DAFx'05*), Madrid, Spain, Sep. 20-22, 2005, 6 pages.

Kepesi, Marian, et al., "High-Resolution Noise-Robust Spectral-Based Pitch Estimation", 2005, 4 pages.

Hu, Guoning, et al., "Monaural Speech Segregation Based on Pitch Tracking and Amplitude Modulation", *IEEE Transactions on Neural Networks*, vol. 15, No. 5, Sep. 2004, 16 pages.

Roa, Sergio, et al., "Fundamental Frequency Estimation Based on Pitch-Scaled Harmonic Filtering", 2007, 4 pages.

Badeau et al., "Expectation-Maximization Algorithm for Multi-Pitch Estimation and Separation of Overlapping Harmonic Spectra", *IEEE International Conference on Acoustics, Speech and Signal Processing* (*ICASSP*), Apr. 2009, 4 pages.

Camacho et al., "A Sawtooth Waveform Inspired Pitch Estimator for Speech and Music", *Journal of the Acoustical Society of America*, vol. 124, No. 3, Sep. 2008, pp. 1638-1652.

Adami et al., "Modeling Prosodic Dynamics for Speaker Recognition," *Proceedings of IEEE International Conference in Acoustics, Speech and Signal Processing*(ICASSP '03), Hong Kong, 2003.

Cooke et al., "Robust automatic speech recognition with missing and unreliable acoustic data," *Speech Communication*, vol. 24, Issue 2, Jun. 2001, pp. 267-285.

Cycling 74, "MSP Yutorial 26: Frequency Domain Signal Processing with pfft~" Jul. 6, 2008 (Captured via Internet Archive) http://www.cycling74.com.

Kamath et al, "Independent Component Analysis for Audio Classification", *IEEE 11th Digital Signal Processing Workshop & IEEE Signal Processing Education Workshop*, [retrieved on: May 31, 2012], http://2002.114.89.42/resource/pdf/1412.pdf, pp. 352-355.

(56) References Cited

OTHER PUBLICATIONS

Kumar et al., "Speaker Recognition Using GMM", *International Journal of Engineering Science and Technology*, vol.2, No. 6, 2010, [retrieved on: May 31, 2012], retrieved from the internet: http://www.ijest.info/docs/IJEST10-02-06-112.pdf, pp. 2428-2436.
Serra, "Musical Sound Modeling with Sinusoids plus Noise", 1997, pp. 1-25.
Vargas-Rubio et aL, "An Improved Spectrogram Using the Multiangle Centered Discrete Fractional Fourier Transform", *Proceedings of International Conference on Acoustics, Speech, and Signal Processing*, Philadelphia, 2005 [retrieved on Jun. 24, 2012], retrieved from the internet: <URL: http://www.ece.unm.edu/faculty/beanthan/PUB/ICASSP-05-JUAN.pdf>, 4 pages.
Werauaga et al., Adaptive Chirp-Based Time-Frequency Analysis of Speech Signals, Speech Communication, vol. 48, No. 5, pp. 474-492 (2006).
Doval et al., "Fundamental Frequency Estimation and Tracking Using Maximum Likelihood Harmonic Matching and HMMs," *IEEE International Conference on Acoustics, Speech, and Signal Processing, Proceedings*, New York, NY, 1:221-224 (Apr. 27, 1993).
Extended European Search Report mailed Feb. 12, 2015, as received in European Patent Application No. 12 821 868.2.
Extended European Search Report mailed Oct. 9, 2014, as received in European Patent Application No. 12 763 782.5.
Extended European Search Report mailed Mar. 12, 2015, as received in European Patent Application No. 12 822 18.9.
Goto, "A Robust Predominant-FO Estimation Method for Real-Time Detection of Melody and Bass Lines in CD Recordings," *Acoustics, Speech, and Signal Processing*, Piscataway, NJ, 2(5):757-760 (Jun. 5, 2000).
International Search Report and Written Opinion mailed Jul. 5, 2012, as received in International Application No. PCT/US2012/030277.
International Search Report and Written Opinion mailed Jun. 7, 2012, as received in International Application No. PCT/US2012/030274.
International Search Report and Written Opinion mailed Oct. 23, 2012, as received in International Application No. PCT/US2012/049901.
International Search Report and Written Opinion mailed Oct. 19, 2012, as received in International Application PCT/US2012/049909.
Ioana et al., "The Adaptive Time-Frequency Distribution Using the Fractional Fourier Transform,"18° Colloque sur le traitement du signal et des images, pp. 52-55 (2001).
Mowlaee et al., "Chirplet Representation for Audio Signals Based on Model Order Selection Criteria," *Computer Systems and Applications, AICCSA 2009, IEEE/ACS International Conference on IEEE*, Piscataway, NJ pp. 927-934 (May 10, 2009).
Weruaga et al., "The Fan-Chirp Transform for Non-Stationary Harmonic Signals," *Signal Processing, Elsevier Science Publishers B.V. Amsterdam, NL*, 87(6): 1505-1506 and 1512 (Feb. 24, 2007).

* cited by examiner

SYSTEM AND METHOD FOR TRACKING SOUND PITCH ACROSS AN AUDIO SIGNAL

FIELD

The invention relates to tracking sound pitch across an audio signal through analysis of audio information that facilitates estimation of fractional chirp rate as well as pitch, and leverages estimated fractional chirp rate along with pitch to track the pitch.

BACKGROUND

Systems and techniques for tracking sound pitch across an audio signal are known. Known techniques implement a transform to transform the audio signal into the frequency domain (e.g., Fourier Transform, Fast Fourier Transform, Short Time Fourier Transform, and/or other transforms) for individual time sample windows, and then attempt to identify pitch within the individual time sample windows by identifying spikes in energy at harmonic frequencies. These techniques assume pitch to be static within the individual time sample windows. As such, these techniques fail to account for the dynamic nature of pitch within the individual time sample windows, and may be inaccurate, imprecise, and/or costly from a processing and/or storage perspective.

SUMMARY

One aspect of the disclosure relates to a system and method configured to analyze audio information derived from an audio signal. The system and method may track sound pitch across the audio signal. The tracking of pitch across the audio signal may take into account change in pitch by determining at individual time sample windows in the signal duration an estimated pitch and an estimated fractional chirp rate of the harmonics at the estimated pitch. The estimated pitch and the estimated fractional chirp rate may then be implemented to determine an estimated pitch for another time sample window in the signal duration with an enhanced accuracy and/or precision.

In some implementations, a system configured to analyze audio information may include one or more processors configured to execute computer program modules. The computer program modules may include one or more of an audio information module, a processing window module, a peak likelihood module, a pitch estimation module, a pitch prediction module, a weighting module, an estimated pitch aggregation module, a voiced section module, and/or other modules.

The audio information module may be configured to obtain audio information derived from an audio signal representing one or more sounds over a signal duration. The audio information correspond to the audio signal during a set of discrete time sample windows. The audio information may specify, as a function of pitch and fractional chirp rate, a pitch likelihood metric for the individual sampling windows in time. The pitch likelihood metric for a given pitch and a given fractional chirp rate in a given time sample window may indicate the likelihood a sound represented by the audio signal had the given pitch and the given fractional chirp rate during the given time sample window.

The audio information module may be configured such that the audio information includes transformed audio information. The transformed audio information for a time sample window may specify magnitude of a coefficient related to signal intensity as a function of frequency for an audio signal within the time sample window. In some implementations, the transformed audio information for the time sample window may include a plurality of sets of transformed audio information. The individual sets of transformed audio information may correspond to different fractional chirp rates. Obtaining the transformed audio information may include transforming the audio signal, receiving the transformed audio information in a communications transmission, accessing stored transformed audio information, and/or other techniques for obtaining information.

The processing window module may be configured to define one or more processing time windows within the signal duration. An individual processing time window may include a plurality of time sample windows. The processing time windows may include a plurality of overlapping processing time windows that span some or all of the signal duration. For example, the processing window module may be configured to define the processing time windows by incrementing the boundaries of the processing time window over the span of the signal duration. The processing time windows may correspond to portions of the signal duration during which the audio signal represents voiced sounds.

The peak likelihood module may be configured to identify, for a processing time window, a maximum in the pitch likelihood metric over the plurality of time sample windows within the processing time window. This may include scanning the pitch likelihood metric within the different time sample windows in the processing time window to identify a maximum value of the pitch likelihood metric in the processing time window.

The pitch estimation module may be configured to determine, for the individual time sample windows in the processing time window, estimated pitch and estimated fractional chirp rate. For the time sample window having the maximum pitch likelihood metric identified by the peak likelihood module, this may be performed by determining the estimated pitch and the estimated fractional chirp rate as the pitch and the fractional chirp rate corresponding to the maximum pitch likelihood metric. For other time sample windows in the processing time window, the pitch estimation module may be configured to determine estimated pitch and estimated fractional chirp rate by iterating through the processing time window from the time sample window having the maximum pitch likelihood metric and determining the estimated pitch and estimated fractional chirp rate for a given time sample window based on (i) the pitch likelihood metric specified by the transformed audio information for the given time sample window, and (ii) the estimated pitch and the estimated fractional chirp rate for a time sample window adjacent to the given time sample window.

To facilitate the determination of an estimated pitch and/or estimated fractional chirp rate for a first time sample window between the time sample window having the maximum pitch likelihood metric and a boundary of the processing time window, the pitch prediction module may be configured to determine a predicted pitch for the first time sample window. The predicted pitch for the first time sample window may be determined based on an estimated pitch and an estimated fractional chirp rate during a second time sample window. The second time sample window may be adjacent to the first time sample window. The determination of the predicted pitch for the first time sample window may be adjusting the estimated pitch for the second time sample window by an amount determined based on the time difference between the first and second time sample windows and the estimated fractional chirp rate for the second time sample window.

To facilitate determination of the estimated pitch and/or the estimated fractional chirp rate for the first time sample window, the weighting module may be configured to weight the pitch likelihood metric for the first time sample window. This weighting may apply relatively larger weights to the pitch likelihood metric at or near the predicted pitch for the first time sample window. The weighting may apply relatively smaller weights to the pitch likelihood metric further away from the predicted pitch for the first time sample window. This may suppress the pitch likelihood metric for pitches that are relatively far from the pitch that would be expected based on the estimated pitch and estimated fractional chirp rate for the second time sample window.

Once the pitch likelihood metric for the first time sample window has been weighted, the pitch estimation module may be configured to determine an estimated pitch for the first time sample window based on the weighted pitch likelihood metric. This may include identifying the pitch and/or the fractional chirp rate for which the weighted pitch likelihood metric is a maximum in the first time sample window.

In implementations in which the processing time windows include overlapping processing time windows within at least a portion of the signal duration, a plurality of estimated pitches may be determined for the first time sample window. For example, the first time sample window may be included within two or more of the overlapping processing time windows. The paths of estimated pitch and/or estimated chirp rate through the processing time windows may be different for individual ones of the overlapping processing time windows. As a result the estimated pitch and/or chirp rate upon which the determination of estimated pitch for the first time sample window may be different within different ones of the overlapping processing time windows. This may cause the estimated pitches determined for the first time sample window to be different. The estimated pitch aggregation module may be configured to determine an aggregated estimated pitch for the first time sample window by aggregating the plurality of estimated pitches determined for the first time sample window.

The estimated pitch aggregation module may be configured such that determining an aggregated estimated pitch. The determination of a mean, a selection of a determined estimated pitch, and/or other aggregation techniques may be weighted (e.g., based on pitch likelihood metric corresponding to the estimated pitches being aggregated).

The voiced section module may be configured to categorize time sample windows into a voiced category, an unvoiced category, and/or other categories. A time sample window categorized into the voiced category may correspond to a portion of the audio signal that represents harmonic sound. A time sample window categorized into the unvoiced category may correspond to a portion of the audio signal that does not represent harmonic sound. Time sample windows categorized into the voiced category may be validated to ensure that the estimated pitches for these time sample windows are accurate. Such validation may be accomplished, for example, by confirming the presence of energy spikes at the harmonics of the estimated pitch in the transformed audio information, confirming the absence in the transformed audio information of periodic energy spikes at frequencies other than those of the harmonics of the estimated pitch, and/or through other techniques.

These and other objects, features, and characteristics of the system and/or method disclosed herein, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION

Figure 1:
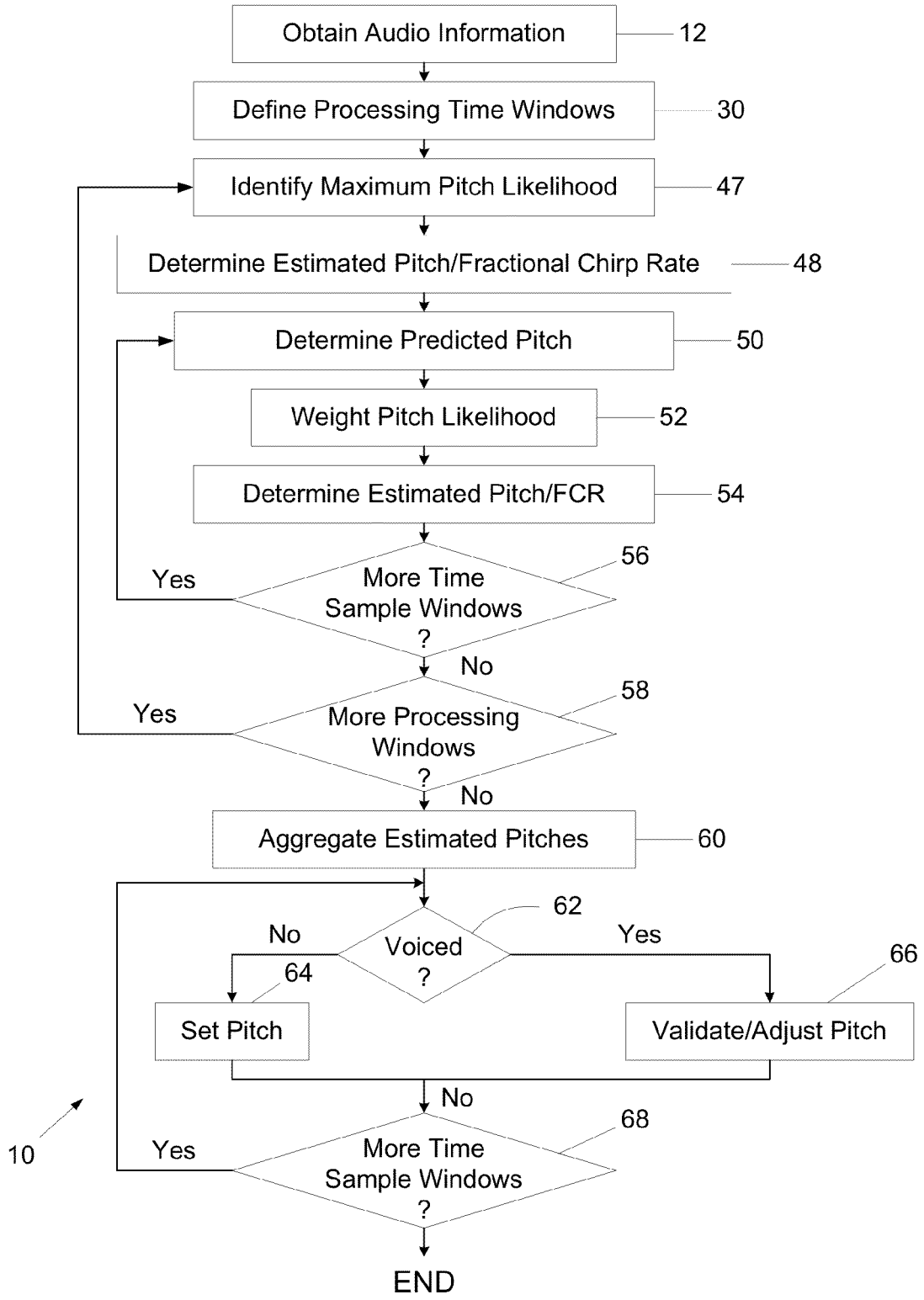
FIG. 1 illustrates a method of analyzing audio information.

FIG. 1 illustrates a method 10 of analyzing audio information derived from an audio signal representing one or more sounds. The method 10 may be configured to determine pitch of the sounds represented in the audio signal with an enhanced accuracy, precision, speed, and/or other enhancements. The method 10 may include determining fractional chirp rate of the sounds, and may leverage the determined fractional chirp rate to track pitch across time.

At an operation 12, audio information derived from an audio signal may be obtained. The audio signal may represent one or more sounds. The audio signal may have a signal duration. The audio information may include audio information that corresponds to the audio signal during a set of discrete time sample windows. The time sample windows may correspond to a period (or periods) of time larger than the sampling period of the audio signal. As a result, the audio information for a time sample window may be derived from and/or represent a plurality of samples in the audio signal. By way of non-limiting example, a time sample window may correspond to an amount of time that is greater than about 15 milliseconds, and/or other amounts of time. In some implementations, the time windows may correspond to about 10 milliseconds, and/or other amounts of time.

The audio information obtained at operation 12 may include transformed audio information. The transformed audio information may include a transformation of an audio signal into the frequency domain (or a pseudo-frequency domain) such as a Fourier Transform, a Fast Fourier Transform, a Short Time Fourier Transform, and/or other transforms. The transformed audio information may include a transformation of an audio signal into a frequency-chirp domain, as described, for example, in U.S. patent application Ser. No. 13/205,424, filed Aug. 8, 2011, and issued as U.S. Pat. No. 8,767,978, on Jun. 1, 2014, and entitled "System And Method For Processing Sound Signals Implementing A Spectral Motion Transform" ("the '978 patent") which is hereby incorporated into this disclosure by reference in its entirety. The transformed audio information may have been transformed in discrete time sample windows over the audio signal. The time sample windows may be overlapping or non-overlapping in time. Generally, the transformed audio information may specify magnitude of a coefficient related to signal intensity as a function of frequency (and/or other parameters) for an audio signal within a time sample window. In the frequency-chirp domain, the transformed audio information may specify magnitude of the coefficient related to signal intensity as a function of frequency and fractional chirp rate. Fractional chirp rate may be, for any harmonic in a sound, chirp rate divided by frequency.

Figure 2:
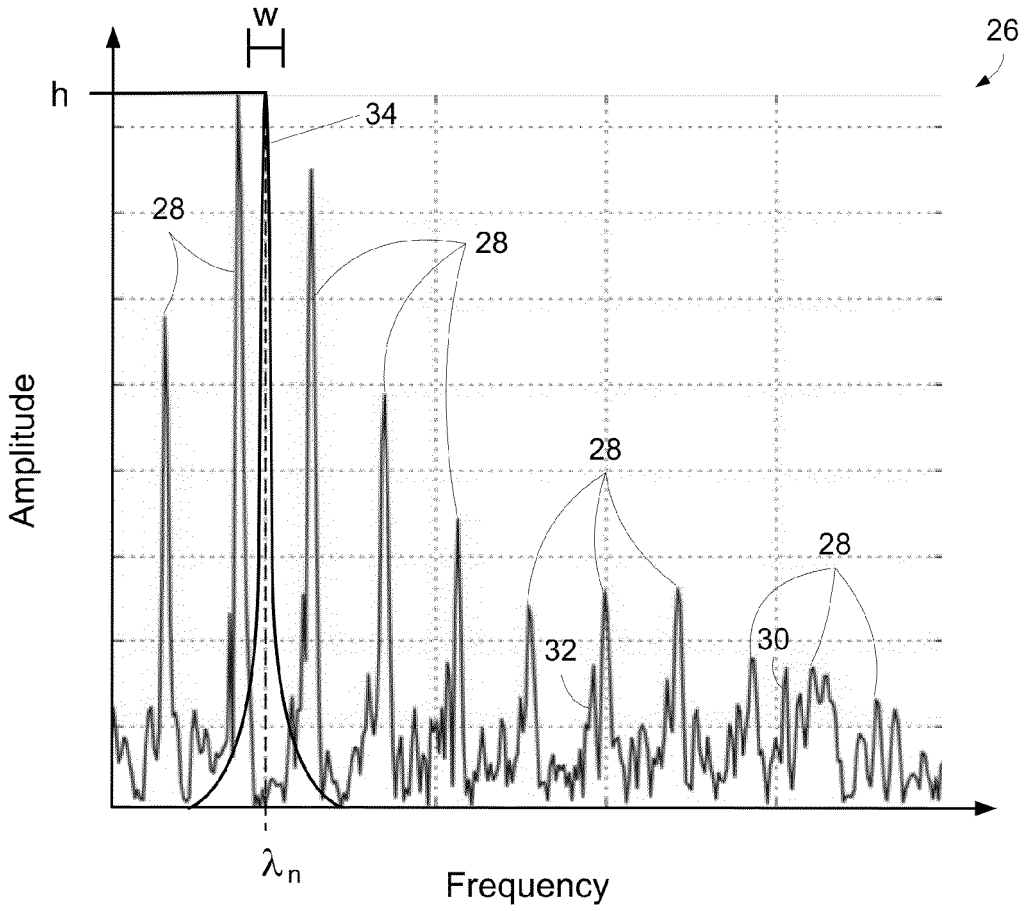
FIG. 2 illustrates plot of a coefficient related to signal intensity as a function of frequency.

By way of illustration, FIG. 2 depicts a plot 14 of transformed audio information. The plot 14 may be in a space that shows a magnitude of a coefficient related to energy as a function of frequency. The transformed audio information represented by plot 14 may include a harmonic sound, represented by a series of spikes 16 in the magnitude of the coefficient at the frequencies of the harmonics of the harmonic sound. Assuming that the sound is harmonic, spikes 16 may be spaced apart at intervals that correspond to the pitch ($\phi$) of the harmonic sound. As such, individual spikes 16 may correspond to individual ones of the harmonics of the harmonic sound.

Other spikes (e.g., spikes 18 and/or 20) may be present in the transformed audio information. These spikes may not be associated with harmonic sound corresponding to spikes 16. The difference between spikes 16 and spike(s) 18 and/or 20 may not be amplitude, but instead frequency, as spike(s) 18 and/or 20 may not be at a harmonic frequency of the harmonic sound. As such, these spikes 18 and/or 20, and the rest of the amplitude between spikes 16 may be a manifestation of noise in the audio signal. As used in this instance, "noise" may not refer to a single auditory noise, but instead to sound (whether or not such sound is harmonic, diffuse, white, or of some other type) other than the harmonic sound associated with spikes 16.

The transformation that yields the transformed audio information from the audio signal may result in the coefficient related to energy being a complex number. The transformation may include an operation to make the complex number a real number. This may include, for example, taking the square of the argument of the complex number, and/or other operations for making the complex number a real number. In some implementations, the complex number for the coefficient generated by the transform may be preserved. In such implementations, for example, the real and imaginary portions of the coefficient may be analyzed separately, at least at first. By way of illustration, plot 14 may represent the real portion of the coefficient, and a separate plot (not shown) may represent the imaginary portion of the coefficient as a function of frequency. The plot representing the imaginary portion of the coefficient as a function of frequency may have spikes at the harmonics of the harmonic sound that corresponds to spikes 16.

In some implementations, the transformed audio information may represent all of the energy present in the audio signal, or a portion of the energy present in the audio signal. For example, if the transformed on the audio signal places the audio signal into a frequency-chirp domain, the coefficient related to energy may be specified as a function of frequency and fractional chirp rate (e.g., as described in the '978 patent). In such examples, the transformed audio information for a given time sample window may include a representation of the energy present in the audio signal having a common fractional chirp rate (e.g., a one-dimensional slice through the two-dimensional frequency-domain along a single fractional chirp rate).

Referring back to FIG. 1, in some implementations, the audio information obtained at operation 12 may represent a pitch likelihood metric as a function of pitch and chirp rate. The pitch likelihood metric at a time sample window for a given pitch and a given fractional chirp rate may indicate the likelihood that a sound represented in the audio signal at the time sample window has the given pitch and the given fractional chirp rate. Such audio information may be derived from the audio signal, for example, by the systems and/or methods described in U.S. patent application Ser. No. 13/205,455, filed Aug. 8, 2011, and entitled "System And Method For Analyzing Audio Information To Determine Pitch And/Or Fractional Chirp Rate" (the '455 application) which is hereby incorporated into the present disclosure in its entirety.

Figure 3:
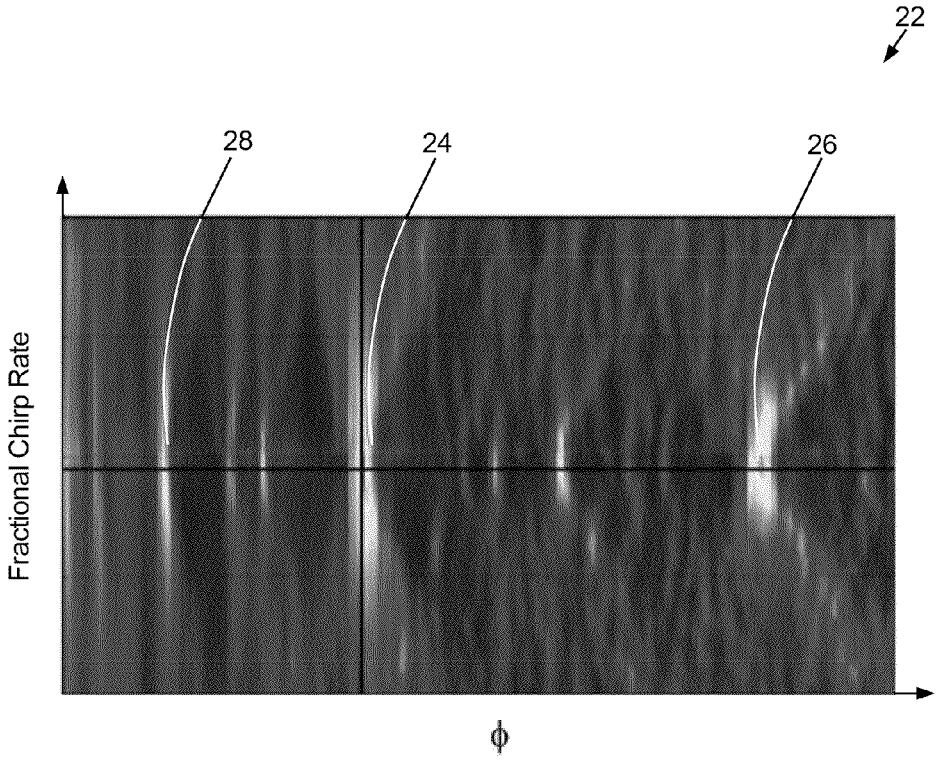
FIG. 3 illustrates a space in which a pitch likelihood metric is specified as a function of pitch and fractional chirp rate.

By way of illustration, FIG. 3 shows a space 22 in which pitch likelihood metric may be defined as a function pitch and fractional chirp rate for a sample time window. In FIG. 3, magnitude of pitch likelihood metric may be depicted by shade (e.g., lighter=greater magnitude). As can be seen, maxima for the pitch likelihood metric may be two-dimensional maxima on pitch and fractional chirp rate. The maxima may include a maximum 24 at the pitch of a sound represented in the audio signal within the time sample window, a maximum 26 at twice the pitch, a maximum 28 at half the pitch, and/or other maxima.

Figure 4:
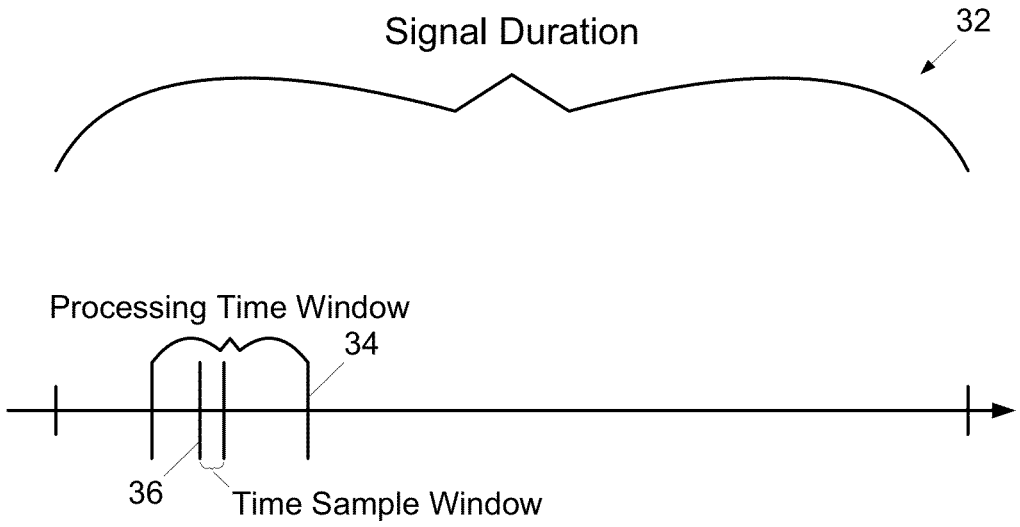
FIG. 4 illustrates a timeline of a signal duration including a defined processing time window and a time sample window within the processing time window.

Turning back to FIG. 1, at an operation 30, a plurality of processing time windows may be defined across the signal duration. A processing time window may include a plurality of time sample windows. The processing time windows may correspond to a common time length. By way of illustration, FIG. 4 illustrates a timeline 32. Timeline 32 may run the length of the signal duration. A processing time window 34 may be defined over a portion of the signal duration. The processing time window 34 may include a plurality of time sample windows, such as time sample window 36.

Referring again to FIG. 1, in some implementations, operation 30 may include identifying, from the audio information, portions of the signal duration for which harmonic sound (e.g., human speech) may be present. Such portions of the signal duration may be referred to as "voiced portions" of the audio signal. In such implementations, operation 30 may include defining the processing time windows to correspond to the voiced portions of the audio signal.

Figure 5:
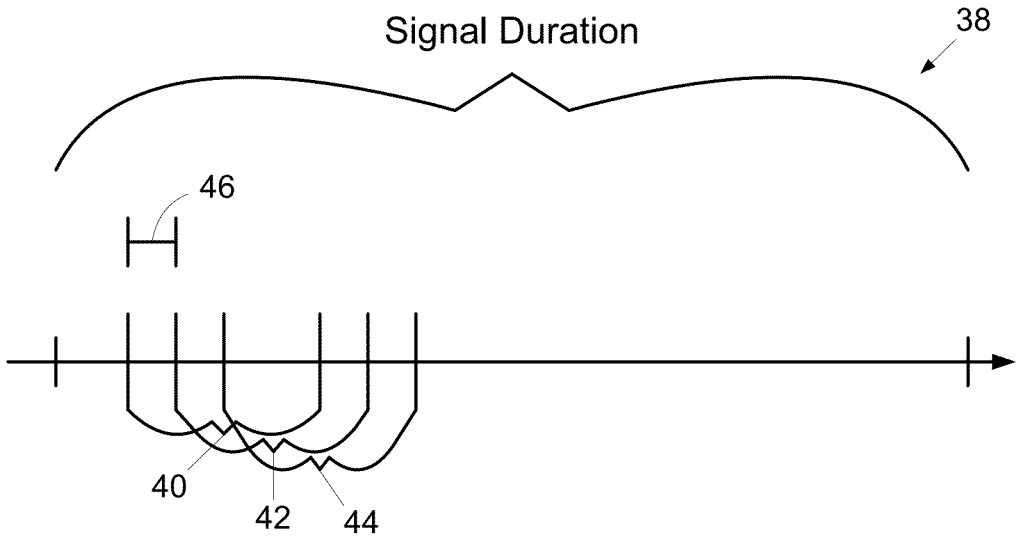
FIG. 5 illustrates a timeline of signal duration including a plurality of overlapping processing time windows.

In some implementations, the processing time windows may include a plurality of overlapping processing time windows. For example, for some or all of the signal duration, the overlapping processing time windows may be defined by incrementing the boundaries of the processing time windows by some increment. This increment may be an integer number of time sample windows (e.g., 1, 2, 3, and/or other integer numbers). by way of illustration, FIG. 5 shows a timeline 38 depicting a first processing time window 40, a second processing time window 42, and a third processing time window 44, which may overlap. The processing time windows 40, 42, and 44 may be defined by incrementing the boundaries by an increment amount illustrated as 46. The incrementing of the boundaries may be performed, for example, such that a set of overlapping processing time windows including windows 40, 42, and 44 extend across the entirety of the signal duration, and/or any portion thereof.

Turning back to FIG. 1, at an operation 47, for a processing time window defined at operation 30, a maximum pitch likelihood may be identified. The maximum pitch likelihood may be the largest likelihood for any pitch and/or chirp rate across the time sample windows within the processing time window. As such, operation 30 may include scanning the audio information for the time sample windows within the processing time window that specifies the pitch likelihood metric for the time sample windows, and identifying the maximum value for the pitch likelihood within all of these processing time windows.

At an operation 48, an estimated pitch for the time sample window having the maximum pitch likelihood metric may be determined. As was mentioned above, the audio information may indicate, for a given time sample window, the pitch likelihood metric as a function of pitch. As such, the estimated pitch for this time sample window may be determined as the pitch for corresponding to the maximum pitch likelihood metric.

As was mentioned above, in the audio information the pitch likelihood metric may further be specified as a function of fractional chirp rate. As such, the pitch likelihood metric may indicate chirp likelihood as a function of the pitch likelihood metric and pitch. At operation 48, in addition to the estimated pitch, an estimated fractional chirp rate may be determined. The estimated fractional chirp rate may be determined as the chirp rate corresponding to the maximum pitch likelihood metric.

At an operation 50, a predicted pitch for a next time sample window in the processing time window may be determined. This time sample window may include, for example, a time sample window that is adjacent to the time sample window having the estimated pitch and estimated fractional chirp rate determined at operation 48. The description of this time sample window as "next" is not intended to limit the this time sample window to an adjacent or consecutive time sample window (although this may be the case). Further, the use of the word "next" does not mean that the next time sample window comes temporally in the audio signal after the time sample window for which the estimated pitch and estimated fractional chirp rate have been determined. For example, the next time sample window may occur in the audio signal before the time sample window for which the estimated pitch and the estimated fractional chirp rate have been determined.

Determining the predicted pitch for the next time sample window may include, for example, incrementing the pitch from the estimated pitch determined at operation 48 by an amount that corresponds to the estimated fractional chirp rate determined at operation 48 and a time difference between the time sample window being addressed at operation 48 and the next time sample window. For example, this determination of a predicted pitch may be expressed mathematically for some implementations as:

$$\phi_1 = \phi_0 + \Delta t \cdot \frac{d\phi}{dt}; \tag{1}$$

where $\phi_0$ represents the estimated pitch determined at operation 48, $\phi_1$ represents the predicted pitch for the next time sample window, $\Delta t$ represents the time difference between the time sample window from operation 48 and the next tsw, and $$\frac{d\phi}{dt}$$

represents an estimated fractional chirp rate of the fundamental frequency of the pitch (which can be determined from the estimated fractional chirp rate).

At an operation 52, for the next time sample window, the pitch likelihood metric may be weighted based on the predicted pitch determined at operation 50. This weighting may apply relatively larger weights to the pitch likelihood metric for pitches in the next time sample window at or near the predicted pitch and relatively smaller weights to the pitch likelihood metric for pitches in the next time sample window that are further away from the predicted pitch. For example, this weighting may include multiplying the pitch likelihood metric by a weighting function that varies as a function of pitch and may be centered on the predicted pitch. The width, the shape, and/or other parameters of the weighting function may be determined based on user selection (e.g., through settings and/or entry or selection), fixed, based on noise present in the audio signal, based on the range of fractional chirp rates in the sample, and/or other factors. As a non-limiting example, the weighting function may be a Gaussian function.

At an operation 54, an estimated pitch for the next time sample window may be determined based on the weighted pitch likelihood metric for the next sample window. Determination of the estimated pitch for the next time sample window may include, for example, identifying a maximum in the weighted pitch likelihood metric and determining the pitch corresponding to this maximum as the estimated pitch for the next time sample window.

At operation 54, an estimated fractional chirp rate for the next time sample window may be determined. The estimated fractional chirp rate may be determined, for example, by identifying the fractional chirp rate for which the weighted pitch likelihood metric has a maximum along the estimated pitch for the time sample window.

At operation 56, a determination may be made as to whether there are further time sample windows in the processing time window for which an estimated pitch and/or an estimated fractional chirp rate are to be determined. Responsive to there being further time sample windows, method 10 may return to operation 50, and operations 50, 52, and 54 may be performed for a further time sample window. In this iteration through operations 50, 52, and 54, the further time sample window may be a time sample window that is adjacent to the next time sample window for which operations 50, 52, and 54 have just been performed. In such implementations, operations 50, 52, and 54 may be iterated over the time sample windows from the time sample window having the maximum pitch likelihood to the boundaries of the processing time window in one or both temporal directions. During the iteration(s) toward the boundaries of the processing time window, the estimated pitch and estimated fractional chirp rate implemented at operation 50 may be the estimated pitch and estimated fractional chirp rate determined at operation 48, or may be an estimated pitch and estimated fractional chirp rate determined at operation 50 for a time sample window adjacent to the time sample window for which operations 50, 52, and 54 are being iterated.

Responsive to a determination at operation 56 that there are no further time sample windows within the processing time window, method 10 may proceed to an operation 58. At operation 58, a determination may be made as to whether there are further processing time windows to be processed. Responsive to a determination at operation 58 that there are further processing time windows to be processed, method 10 may return to operation 47, and may iterate over operations 47, 48, 50, 52, 54, and 56 for a further processing time window. It will be appreciate that iterating over the processing time windows may be accomplished in the manner shown in FIG. 1 and described herein, is not intended to be limiting. For example, in some implementations, a single processing time window may be defined at operation 30, and the further processing time window(s) may be defined individually as method 10 reaches operation 58.

Responsive to a determination at operation 58 that there are no further processing time windows to be processed, method 10 may proceed to an operation 60. Operation 60 may be performed in implementations in which the processing time windows overlap. In such implementations, iteration of operations 47, 48, 50, 52, 54, and 56 for the processing time windows may result in multiple determinations of estimated pitch for at least some of the time sample windows. For time sample windows for which multiple determinations of estimated pitch have been made, operation 60 may include aggregating such determinations for the individual time sample windows to determine aggregated estimated pitch for individual the time sample windows.

By way of non-limiting example, determining an aggregated estimated pitch for a given time sample window may include determining a mean estimated pitch, determining a median estimated pitch, selecting an estimated pitch that was determined most often for the time sample window, and/or other aggregation techniques. At operation 60, the determination of a mean, a selection of a determined estimated pitch, and/or other aggregation techniques may be weighted. For example, the individually determined estimated pitches for the given time sample window may be weighted according to their corresponding pitch likelihood metrics. These pitch likelihood metrics may include the pitch likelihood metrics specified in the audio information obtained at operation 12, the weighted pitch likelihood metric determined for the given time sample window at operation 52, and/or other pitch likelihood metrics for the time sample window.

At an operation 62, individual time sample windows may be divided into voiced and unvoiced categories. The voiced time sample windows may be time sample windows during which the sounds represented in the audio signal are harmonic or "voiced" (e.g., spoken vowel sounds). The unvoiced time sample windows may be time sample windows during which the sounds represented in the audio signal are not harmonic or "unvoiced" (e.g., spoken consonant sounds).

In some implementations, operation 62 may be determined based on a harmonic energy ratio. The harmonic energy ratio for a given time sample window may be determined based on the transformed audio information for given time sample window. The harmonic energy ratio may be determined as the ratio of the sum of the magnitudes of the coefficient related to energy at the harmonics of the estimated pitch (or aggregated estimated pitch) in the time sample window to the sum of the magnitudes of the coefficient related to energy at the harmonics across the spectrum for the time sample window. The transformed audio information implemented in this determination may be specific to an estimated fractional chirp rate (or aggregated estimated fractional chirp rate) for the time sample window (e.g., a slice through the frequency-chirp domain along a common fractional chirp rate). The transformed audio information implemented in this determination may not be specific to a particular fractional chirp rate.

For a given time sample window if the harmonic energy ratio is above some threshold value, a determination may be made that the audio signal during the time sample window represents voiced sound. If, on the other hand, for the given time sample window the harmonic energy ratio is below the threshold value, a determination may be made that the audio signal during the time sample window represents unvoiced sound. The threshold value may be determined, for example, based on user selection (e.g., through settings and/or entry or selection), fixed, based on noise present in the audio signal, based on the fraction of time the harmonic source tends to be active (e.g. speech has pauses), and/or other factors.

In some implementations, operation 62 may be determined based on the pitch likelihood metric for estimated pitch (or aggregated estimated pitch). For example, for a given time sample window if the pitch likelihood metric is above some threshold value, a determination may be made that the audio signal during the time sample window represents voiced sound. If, on the other hand, for the given time sample window the pitch likelihood metric is below the threshold value, a determination may be made that the audio signal during the time sample window represents unvoiced sound. The threshold value may be determined, for example, based on user selection (e.g., through settings and/or entry or selection), fixed, based on noise present in the audio signal, based on the fraction of time the harmonic source tends to be active (e.g. speech has pauses), and/or other factors.

Responsive to a determination at operation 62 that the audio signal during a time sample window represents unvoiced sound, the estimated pitch (or aggregated estimated pitch) for the time sample window may be set to some predetermined value at an operation 64. For example, this value may be set to 0, or some other value. This may cause the tracking of pitch accomplished by method 10 to designate that harmonic speech may not be present or prominent in the time sample window.

Responsive to a determination at operation 62, that the audio signal during a time sample window represents voiced sound, method 10 may proceed to an operation 68.

At operation 68, a determination may be made as to whether further time sample windows should be processed by operations 62 and/or 64. Responsive to a determination that further time sample windows should be processed, method 10 may return to operation 62 for a further time sample window. Responsive to a determination that there are no further time sample windows for processing, method 10 may end.

It will be appreciated that the description above of estimating an individual pitch for the time sample windows is not intended to be limiting. In some implementations, the portion of the audio signal corresponding to one or more time sample window may represent two or more harmonic sounds. In such implementations, the principles of pitch tracking above with respect to an individual pitch may be implemented to track a plurality of pitches for simultaneous harmonic sounds without departing from the scope of this disclosure. For example, if the audio information specifies the pitch likelihood metric as a function of pitch and fractional chirp rate, then maxima for different pitches and different fractional chirp rates may indicate the presence of a plurality of harmonic sounds in the audio signal. These pitches may be tracked separately in accordance with the techniques described herein.

The operations of method 10 presented herein are intended to be illustrative. In some embodiments, method 10 may be accomplished with one or more additional operations not described, and/or without one or more of the operations discussed. Additionally, the order in which the operations of method 10 are illustrated in FIG. 1 and described herein is not intended to be limiting.

In some embodiments, method 10 may be implemented in one or more processing devices (e.g., a digital processor, an analog processor, a digital circuit designed to process information, an analog circuit designed to process information, a state machine, and/or other mechanisms for electronically processing information). The one or more processing devices may include one or more devices executing some or all of the operations of method 10 in response to instructions stored electronically on an electronic storage medium. The one or more processing devices may include one or more devices configured through hardware, firmware, and/or software to be specifically designed for execution of one or more of the operations of method 10.

Figure 6:
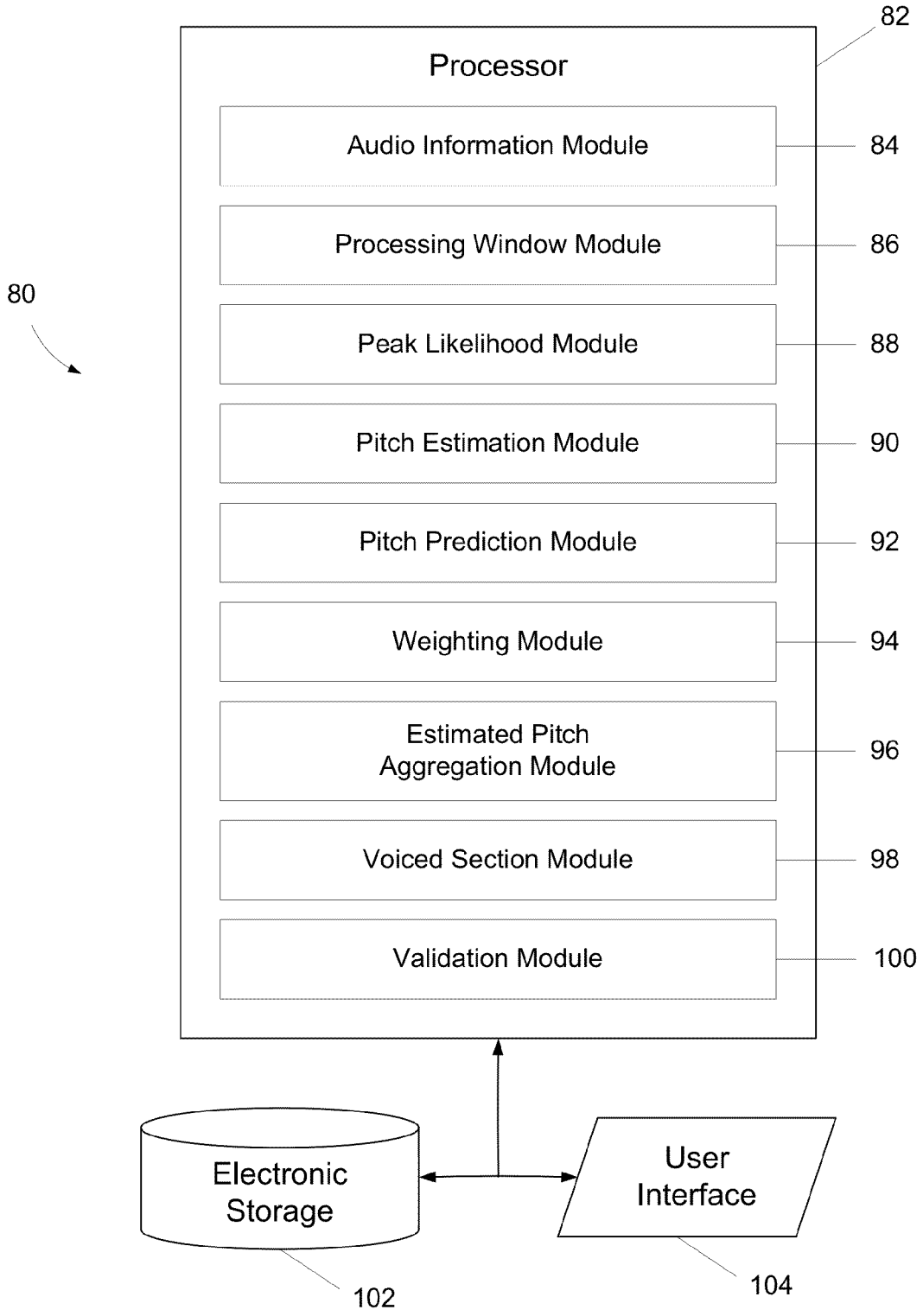
FIG. 6 illustrates a system configured to analyze audio information.

FIG. 6 illustrates a system 80 configured to analyze audio information. In some implementations, system 80 may be configured to implement some or all of the operations described above with respect to method 10 (shown in FIG. 1 and described herein). The system 80 may include one or more of one or more processors 82, electronic storage 102, a user interface 104, and/or other components.

The processor 82 may be configured to execute one or more computer program modules. The computer program modules may be configured to execute the computer program module (s) by software; hardware; firmware; some combination of software, hardware, and/or firmware; and/or other mechanisms for configuring processing capabilities on processor 82. In some implementations, the one or more computer program modules may include one or more of an audio information module 84, a processing window module 86, a peak likelihood module 88, a pitch estimation module 90, a pitch prediction module 92, a weighting module 94, an estimated pitch aggregation module 96, a voice section module 98, and/or other modules.

The audio information module 84 may be configured to obtain audio information derived from an audio signal. Obtaining the audio information may include deriving audio information, receiving a transmission of audio information, accessing stored audio information, and/or other techniques for obtaining information. The audio information may be divided in to time sample windows. In some implementations, audio information module 84 may be configured to perform some or all of the functionality associated herein with operation 12 of method 10 (shown in FIG. 1 and described herein).

The processing window module 86 may be configured to define processing time windows across the signal duration of the audio signal. The processing time windows may be overlapping or non-overlapping. An individual processing time windows may span a plurality of time sample windows. In some implementations, processing window module 86 may perform some or all of the functionality associated herein with operation 30 of method 10 (shown in FIG. 1 and described herein).

The peak likelihood module 88 may be configured to determine, within a given processing time window, a maximum in pitch likelihood metric. This may involve scanning the pitch likelihood metric across the time sample windows in the given processing time window to find the maximum value for pitch likelihood metric. In some implementations, peak likelihood module 88 may be configured to perform some or all of the functionality associated herein with operation 47 of method 10 (shown in FIG. 1 and described herein).

The pitch estimation module 90 may be configured to determine an estimated pitch and/or an estimated fractional chirp rate for a time sample window having the maximum pitch likelihood metric within a processing time window. Determining the estimated pitch and/or the estimated fractional chirp rate may be performed based on a specification of pitch likelihood metric as a function of pitch and fractional chirp rate in the obtained audio information for the time sample window. For example, this may include determining the estimated pitch and/or estimated fractional chirp rate by identifying the pitch and/or fractional chirp rate that correspond to the maximum pitch likelihood metric. In some implementations, pitch estimation module 90 may be configured to perform some or all of the functionality associated herein with operation 48 in method 10 (shown in FIG. 1 and described herein).

The pitch prediction module 92 may be configured to determine a predicted pitch for a first time sample window within the same processing time window as a second time sample window for which an estimated pitch and an estimated fractional chirp rate have previously been determined. The first and second time sample windows may be adjacent. Determination of the predicted pitch for the first time sample window may be made based on the estimated pitch and the estimated fractional chirp rate for the second time sample window. In some implementations, pitch prediction module 92 may be configured to perform some or all of the functionality associated herein to operation 50 of method 10 (shown in FIG. 1 and described herein).

The weighting module 94 may be configured to determine the pitch likelihood metric for the first time sample window based on the predicted pitch determined for the first time sample window. This may include applying relatively higher weights to the pitch likelihood metric specified for pitches at or near the predicted pitch and/or applying relatively lower weights to the pitch likelihood metric specified for pitches farther away from the predicted pitch. In some implementations, weighting module 94 may be configured to perform some or all of the functionality associated herein with operation 52 in method 10 (shown in FIG. 1 and described herein).

The pitch estimation module 90 may be further configured to determine an estimated pitch and/or an estimated fractional chirp rate for the first time sample window based on the weighted pitch likelihood metric for the first time sample window. This may include identifying a maximum in the weighted pitch likelihood metric for the first time sample window. The estimated pitch and/or estimated fractional chirp rate for the first time sample window may be determined as the pitch and/or fractional chirp rate corresponding to the maximum weighted pitch likelihood metric for the first time sample window. In some implementations, pitch estimation module 90 may be configured to perform some or all of the functionality associated herein with operation 54 in method 10 (shown in FIG. 1 and described herein).

As, for example, described herein with respect to operations 47, 48, 50, 52, 54, and/or 56 in method 10 (shown in FIG. 1 and described herein), modules 88, 90, 92, 94, and/or other modules may operate to iteratively determine estimated pitch for the time sample windows across a processing time window defined by module processing window module 86. In some implementations, the operation of modules, 88, 90, 92, 94, and/or other modules may iterate across a plurality of processing time windows defined by processing window module 86, as was described, for example, with respect to operations 30, 47, 48, 50, 52, 54, 56, and/or 58 in method 10 (shown in FIG. 1 and described herein).

The estimated pitch aggregation module 96 may be configured to aggregate a plurality of estimated pitches determined for an individual time sample window. The plurality of estimated pitches may have been determined for the time sample window during analysis of a plurality of processing time windows that included the time sample window. Operation of estimated pitch aggregation module 96 may be applied to a plurality of time sample windows individually across the signal duration. In some implementations, estimated pitch aggregation module 96 may be configured to perform some or all of the functionality associated herein with operation 60 in method 10 (shown in FIG. 1 and described herein).

Processor 82 may be configured to provide information processing capabilities in system 80. As such, processor 82 may include one or more of a digital processor, an analog processor, a digital circuit designed to process information, an analog circuit designed to process information, a state machine, and/or other mechanisms for electronically processing information. Although processor 82 is shown in FIG. 6 as a single entity, this is for illustrative purposes only. In some implementations, processor 82 may include a plurality of processing units. These processing units may be physically located within the same device, or processor 82 may represent processing functionality of a plurality of devices operating in coordination (e.g., "in the cloud", and/or other virtualized processing solutions).

It should be appreciated that although modules 84, 86, 88, 90, 92, 94, 96, and 98 are illustrated in FIG. 6 as being co-located within a single processing unit, in implementations in which processor 82 includes multiple processing units, one or more of modules 84, 86, 88, 90, 92, 94, 96, and/or 98 may be located remotely from the other modules. The description of the functionality provided by the different modules 84, 86, 88, 90, 92, 94, 96, and/or 98 described below is for illustrative purposes, and is not intended to be limiting, as any of modules 84, 86, 88, 90, 92, 94, 96, and/or 98 may provide more or less functionality than is described. For example, one or more of modules 84, 86, 88, 90, 92, 94, 96, and/or 98 may be eliminated, and some or all of its functionality may be provided by other ones of modules 84, 86, 88, 90, 92, 94, 96, and/or 98. As another example, processor 82 may be configured to execute one or more additional modules that may perform some or all of the functionality attributed below to one of modules 84, 86, 88, 90, 92, 94, 96, and/or 98.

Electronic storage 102 may comprise electronic storage media that stores information. The electronic storage media of electronic storage 102 may include one or both of system storage that is provided integrally (i.e., substantially non-removable) with system 102 and/or removable storage that is removably connectable to system 80 via, for example, a port (e.g., a USB port, a firewire port, etc.) or a drive (e.g., a disk drive, etc.). Electronic storage 102 may include one or more of optically readable storage media (e.g., optical disks, etc.), magnetically readable storage media (e.g., magnetic tape, magnetic hard drive, floppy drive, etc.), electrical charge-based storage media (e.g., EEPROM, RAM, etc.), solid-state storage media (e.g., flash drive, etc.), and/or other electronically readable storage media. Electronic storage 102 may include virtual storage resources, such as storage resources provided via a cloud and/or a virtual private network. Electronic storage 102 may store software algorithms, information determined by processor 82, information received via user interface 104, and/or other information that enables system 80 to function properly. Electronic storage 102 may be a separate component within system 80, or electronic storage 102 may be provided integrally with one or more other components of system 80 (e.g., processor 82).

User interface 104 may be configured to provide an interface between system 80 and users. This may enable data, results, and/or instructions and any other communicable items, collectively referred to as "information," to be communicated between the users and system 80. Examples of interface devices suitable for inclusion in user interface 104 include a keypad, buttons, switches, a keyboard, knobs, levers, a display screen, a touch screen, speakers, a microphone, an indicator light, an audible alarm, and a printer. It is to be understood that other communication techniques, either hard-wired or wireless, are also contemplated by the present invention as user interface 104. For example, the present invention contemplates that user interface 104 may be integrated with a removable storage interface provided by electronic storage 102. In this example, information may be loaded into system 80 from removable storage (e.g., a smart card, a flash drive, a removable disk, etc.) that enables the user(s) to customize the implementation of system 80. Other exemplary input devices and techniques adapted for use with system 80 as user interface 104 include, but are not limited to, an RS-232 port, RF link, an IR link, modem (telephone, cable or other). In short, any technique for communicating information with system 80 is contemplated by the present invention as user interface 104.

Although the system(s) and/or method(s) of this disclosure have been described in detail for the purpose of illustration based on what is currently considered to be the most practical and preferred implementations, it is to be understood that such detail is solely for that purpose and that the disclosure is not limited to the disclosed implementations, but, on the contrary, is intended to cover modifications and equivalent arrangements that are within the spirit and scope of the appended claims. For example, it is to be understood that the present disclosure contemplates that, to the extent possible, one or more features of any implementation can be combined with one or more features of any other implementation.

What is claimed is:

1. A method for analyzing an audio signal, the method comprising:

obtaining, using a computer processor, a first pitch and a first fractional chirp rate from a first portion of the audio signal;

determining, using the computer processor, a predicted pitch corresponding to the first pitch in a second portion of the audio signal, the predicted pitch being determined using the first pitch, the first fractional chirp rate, a first time corresponding to the first portion, and a second time corresponding to the second portion;

obtaining, using the computer processor, a pitch likelihood metric in a multi-dimensional representation for the second portion of the audio signal;

determining, using the computer processor, a weighting function using the predicted pitch;

determining, using the computer processor, a weighted pitch likelihood metric using the pitch likelihood metric and the weighting function; and determining, using the computer processor, a second pitch from the second portion of the audio signal using the weighted pitch likelihood metric.

2. The method of claim 1, further comprising determining a second fractional chirp rate from the second portion of the audio signal using the weighted pitch likelihood metric.

3. The method of claim 1, further comprising determining a pitch likelihood metric for the first portion of the audio signal, wherein the first pitch and first fractional chirp rate are obtained from the pitch likelihood metric for the first portion of the audio signal.

4. The method of claim 1, wherein the predicted pitch is computed by multiplying a time difference between the second time and the first time by the fractional chirp rate and adding a result of the multiplication to the first pitch.

5. The method of claim 1, wherein the pitch likelihood metric for a given pitch indicates a likelihood a sound represented by the audio signal has the given pitch.

6. The method of claim 1, wherein the weighting function is a Gaussian function.

7. The method of claim 1, wherein the first portion of the audio signal corresponds to a first time sample window of the audio signal and the second portion of the audio signal corresponds to a second time sample window of the audio signal.

8. The method of claim 1. wherein the multi-dimensional representation includes a first domain corresponding to pitch and a second domain corresponding to fractional chirp rate.

9. A system configured to analyze an audio signal, the system comprising:

an electronic storage storing computer program modules that include computer program instructions; and one or more processors coupled to the electronic storage and configured to execute the computer program instructions to:

obtain a first pitch and a first fractional chirp rate from a first portion of the audio signal;

determine a predicted pitch corresponding to the first pitch in a second portion of the audio signal, the predicted pitch being determined using the first pitch, the first fractional chirp rate, a first time corresponding to the first portion, and a second time corresponding to the second portion;

obtain a pitch likelihood metric in a multi-dimensional representation for the second portion of the audio signal;

determine a weighting using the predicted pitch;

determine a weighted pitch likelihood metric using the pitch likelihood metric and the weighting function; and determine a second pitch from the second portion of the audio signal using the weighted pitch likelihood metric.

10. The system of claim 9, wherein the one or more processors are further configured to execute the computer program instructions to determine a second fractional chirp rate from the second portion of the audio signal using the weighted pitch likelihood metric.

11. The system of claim 9, wherein the one or more processors are further configured to execute the computer program instructions to determine a pitch likelihood metric for the first portion of the audio signal, wherein the first pitch and first fractional chirp rate are obtained from the pitch likelihood metric for the first portion of the audio signal.

12. The system of claim 9, wherein the predicted pitch is computed by multiplying a time difference between the second time and the first time by the fractional chirp rate and adding a result of the multiplication to the first pitch.

13. The system of claim 9, wherein the pitch likelihood metric for a given pitch indicates a likelihood a sound represented by the audio signal has the given pitch.

14. The system of claim 9, wherein the weighting function is a Gaussian function.

15. The system of claim 9, wherein the first portion of the audio signal corresponds to a first time sample window of the audio signal and the second portion of the audio signal corresponds to a second time sample window of the audio signal.

16. The system of claim 9, wherein the multi-dimensional representation includes a first domain corresponding to pitch and a second domain corresponding to fractional chirp rate.

17. A non-transitory computer readable storage medium having data stored therein representing computer program modules executable by a computer, the computer program modules including instructions to track pitch in an audio signal, the storage medium comprising:

instructions for obtaining a first pitch and a first fractional chirp rate from a first portion of the audio signal;

instructions for determining a predicted pitch corresponding to the first pitch in a second portion of the audio signal, the predicted pitch being determined using the first pitch, the first fractional chirp rate, a first time corresponding to the first portion, and a second time corresponding to the second portion;

instructions for obtaining a pitch likelihood metric in a multi-dimensional representation for the second portion of the audio signal;

instructions for determining a weighting function using the predicted pitch;

instructions for determining a weighted pitch likelihood metric using the pitch likelihood metric and the weighting function; and instructions for determining a second pitch from the second portion of the audio signal using the weighted pitch likelihood metric.

18. The non-transitory computer readable storage medium of claim 17, further comprising instructions for determining a second fractional chirp rate from the second portion of the audio signal using the weighted pitch likelihood metric.

19. The non-transitory computer readable storage medium of claim 17, further comprising instructions for determining a pitch likelihood metric for the first portion of the audio signal, wherein the first pitch and first fractional chirp rate are obtained from the pitch likelihood metric for the first portion of the audio signal.

20. The non-transitory computer readable storage medium of claim 17, wherein the predicted pitch is computed by multiplying a time difference between the second time and the first time by the fractional chirp rate and adding a result of the multiplication to the first pitch.

21. The non-transitory computer readable storage medium of claim 17, wherein the pitch likelihood metric for a given pitch indicates a likelihood a sound represented by the audio signal has the given pitch.

22. The non-transitory computer readable storage medium of claim 17, wherein the weighting function is a Gaussian function.

23. The non-transitory computer readable storage medium of claim 17, wherein the multi-dimensional representation includes a first domain corresponding to pitch and a second domain corresponding to fractional chirp rate.

* * * * *